US005894896A

United States Patent [19]

Smith et al.

[11] Patent Number: 5,894,896

[45] Date of Patent: Apr. 20, 1999

[54] ORIENTING TOOL FOR COILED TUBING DRILLING

[75] Inventors: Donald Smith; Andre Naumann; Lennard Sihlis, all of Alberta, Canada

[73] Assignee: Canadian Fracmaster Ltd., Canada

[21] Appl. No.: 08/697,201

[22] Filed: Aug. 21, 1996

[30] Foreign Application Priority Data

Aug. 9, 1996 [CA] Canada ..... 2183033

[51] Int. Cl.[6] ..... E21B 7/08

[52] U.S. Cl. ..... 175/73; 175/322

[58] Field of Search ..... 175/73, 61, 322, 175/74

[56] References Cited

U.S. PATENT DOCUMENTS

| | | | |
|---|---|---|---|
| 5,215,151 | 6/1993 | Smith et al. | 175/45 |
| 5,311,952 | 5/1994 | Eddison et al. | 175/61 |
| 5,316,093 | 5/1994 | Morin et al. | 175/73 X |
| 5,316,094 | 5/1994 | Pringle | 175/74 |
| 5,339,913 | 8/1994 | Rives | 175/73 |
| 5,373,898 | 12/1994 | Pringle | 166/72 |
| 5,485,889 | 1/1996 | Gray | 175/61 |

FOREIGN PATENT DOCUMENTS

| | | |
|---|---|---|
| 2079071 | 3/1993 | Canada . |
| 2096820 | 11/1993 | Canada . |
| 2105474 | 4/1994 | Canada . |
| 2271795 | 4/1994 | United Kingdom . |

*Primary Examiner*—Hoang C. Dang

*Attorney, Agent, or Firm*—Lerner, David, Littenberg, Krumholz & Mentlik

[57] ABSTRACT

There is described an improved apparatus for azimuthal orientation of a tool in a wellbore. The apparatus comprises a tubular housing, a mandrel rotatably supported in the tubular housing and extending therefrom for connection to a tool for rotation thereof, a piston mandrel axially aligned with and connected to the mandrel, a piston longitudinally movable in an annulus between the piston mandrel and the tubular housing and being non-rotatable relative to the tubular housing, at least one pin longitudinally movable in concert with the piston arranged to track in respective helical grooves in the mandrel causing rotation of the mandrel in response to longitudinal movement of the pins, and a flow path for selective delivery of pressurized hydraulic fluid to either side of the piston for rotating the mandrel in either the clockwise or counterclockwise directions, or to both sides of the piston equally to maintain the mandrel in a fixed annular orientation.

29 Claims, 8 Drawing Sheets

ORIENTING TOOL FOR COILED TUBING DRILLING

FIELD OF THE INVENTION

The field of the present invention relates to directional drilling with a bottom hole tool assembly suspended in a borehole and, in particular, to a hydraulically actuated orienting tool for a coiled tubing drilling assembly useful to control and adjust the azimuth of the borehole trajectory.

BACKGROUND OF THE INVENTION

Increasingly, the drilling of oil and gas wells is no longer a matter of drilling vertically straight boreholes from the surface to a zone of hydrocarbon recovery using a traditional drilling platform. Such platforms are surmounted by a derrick which supports a string of jointed drill pipe with a bit at the lower end of the pipe. Technology and techniques have now been developed to change the angle of the bore's trajectory by up to and sometimes exceeding 90° from the vertical. Directional drilling using coiled tubing rather than jointed pipe can offer numerous advantages compared to conventional drilling including new approaches to oil and gas traps having non-conventional geometries, economic zone enhancement as can occur for example if the borehole is deviated to actually follow an oil or gas bearing strata, improved economics particularly in an under-balanced environment (when formation pressure is sufficient to force hydrocarbons to the surface at potentially explosive rates) and reduced environmental degradation.

After deviating a borehole from the vertical, it's obviously no longer completely practical to sustain continuous drilling operations by rotating the drill string in order to also rotate the bit. Preferably only the bit but not the string is rotated by a downhole motor attached to the lower end of the drill pipe, the motor typically consisting of a rotor-stator to generate torque as drilling fluid passes between the rotor and stator, a bent housing (sometimes also referred to as a bent "sub") to deviate the hole by the required amount and which also surrounds a drive shaft that transmits the rotor/stator's torque to a bearing assembly, and a bit rotatably supported at the downhole end of the bearing assembly for cutting the borehole. The bent housing causes the centre line of the components downhole of its position, including the bit, to be at a different angle to the centre line of the components on its uphole end, including the drill string. As the drilling continues, the bit will therefore deviate from the vertical in a curved path in the direction of the bend of the bent housing.

Electronic means supported by a mule shoe in the bottom hole assembly and connected to the surface by a wire line passing through the interior of the drill string transmits information with respect to the amount of curvature in the borehole's trajectory so that it can be plotted. Once the required curvature has been attained so that the axis of the bit's rotation is pointed in the desired direction, the drilling is stopped and the motor must be withdrawn from the well. The bent housing is then either removed or straightened (if it's of the adjustable sort) and the motor is tripped back into the hole to resume drilling. Each time the motor requires service, or a change in the hole's direction is required, this process must be repeated. This results in substantial costs and down time largely due to the time required to make and break all of the joints as the drill string is tripped in and out of the hole. For this reason, jointed drill pipe is now being replaced whenever possible with coiled tubing.

In addition to controlling the bend angle in the coil tubing, it is also necessary to orient the bend point to control and adjust the borehole's bearing or azimuth. Examples of orienting tools for controlling azimuth are disclosed in U.S. Pat. Nos. 5,311,952, 5,316,094, 5,215,151 and 5,373,898 and in U.K. Application Serial No. 2,271,795A.

The orienting tool described in U.S. Pat. No. 5,311,952 includes an upper tubular housing that remains in fixed orientation relative to the coiled tubing. A mandrel is slidably and rotatably received within the upper housing, the mandrel including a piston at its upper end. The piston and mandrel are normally biased into a first position by a coil spring. A lower tubular housing extends from the lower end of the upper housing and is coupled to a mandrel by means of splines so that it rotates with the mandrel. The lower housing therefore rotates relative to the upper housing but cannot move longitudinally relative thereto. A lug and lobe indexing system is employed to turn housing 56 in predetermined increments in response to up and down movements of the mandrel. A nozzle is provided at the bottom of the mandrel. At normal flow rates of the drilling mud, the pressure drop across this nozzle is sufficient to force the mandrel down into its lower position against the force of the coil spring. If the mud flow is reduced sufficiently, spring 40, assisted by reactive torque from the bit, will raise the mandrel to its upper position. This up and down movement of the mandrel engages the indexing system to incrementally rotate the mandrel 45° for each up and down cycle of the mandrel. This tool therefore cannot be activated independently of the drilling fluid, is rotationally unidirectional, and positional control of less than 45° increments is possible only by means of regulating the weight-on-bit (WOB) requiring complicated methodology.

U.S. Pat. No. 5,316,094 describes an orienting tool including an outer cylindrical housing and an inner rotatable mandrel that connects at the lower end of the housing with another portion connectable to a motor for imparting an orienting torque to the bent housing. The annulus between the mandrel and the housing encloses a piston which is non-rotatable relative to the mandrel. The piston is connected to a piston follower having a pin which travels in a 360° degree helical groove in the mandrel. Movement of this pin in the longitudinal direction is translated into rotation of the mandrel which includes a ratchet mechanism which allows rotation in one direction only in 10° increments. This tool is controlled by hydraulic fluid delivered from the surface through a single supply line. Hydraulic fluid is apparently delivered with sufficient pressure to overcome the force of a spring and the drilling fluid acting on the lower side of the piston to drive the piston down which rotates the mandrel. This tool rotates in one direction only and lacks infinite positioning control.

U.K. Application No. 2,271,795 describes a combination bent sub and orienting tool which is actuatable from the surface such as by means of hydraulic supply lines which permit operation of the tool independent of the flow of drilling fluids and with weight-on-bit. However, changes in the bend angle are also accompanied by changes in orientation which can produce unwanted deviations in the borehole trajectory.

It is therefore desirable to produce an orienting tool which is controlled independently from the mud flow rate. It is also desirable to eliminate the need for weight to be applied to the drill bit but which nevertheless is adjustable with weight-on-bit. It is further desirable to provide an orienting tool which can be rotated in either direction as required.

SUMMARY OF THE INVENTION

It is therefore an object of the present invention to overcome the disadvantages of the prior art and provide an orienting tool for use with a directional drilling system, particularly where the drill string utilizes coiled tubing, wherein the orienting tool can rotate the bottom hole assembly in both a clockwise and counterclockwise direction.

It is a further object of the present invention to provide an orienting tool which has infinite positioning control over its entire rotational range.

It is a further object of the present invention to provide an orienting tool which is controlled independently of drilling fluid pumped and can be operated with any type of drilling fluid.

It is a further object of the present invention to provide an orienting tool which can operate with or without weight on the bottom hole assembly bit.

It is a further object of the present invention to provide an orienting tool which can be operated from the surface and is easy to install and replace.

According to the present invention, there is provided apparatus for azimuthal orientation of a tool in a wellbore, said apparatus comprising a tubular housing, mandrel means rotatably supported in said tubular housing and extending therefrom for connection to a tool for rotation thereof, piston mandrel means axially aligned with and connected to said mandrel means, piston means longitudinally movable in an annulus between said piston mandrel and said tubular housing and being non-rotatable relative to said tubular housing, pin means longitudinally movable in concert with said piston means arranged to track in respective helical groove means in said mandrel means causing rotation of said mandrel means in response to longitudinal movement of said pin means, and flow path means for selective delivery of pressurized hydraulic fluid to either side of said piston means for rotating said mandrel means in either the clockwise or counterclockwise directions, or to both sides of said piston means equally to maintain said mandrel means in a fixed annular orientation.

BRIEF DESCRIPTION OF THE DRAWINGS

Preferred embodiments of the present invention will now be described and will be better understood when read in conjunction with the accompanying drawings, in which.

DETAILED DESCRIPTION

Figure 1:
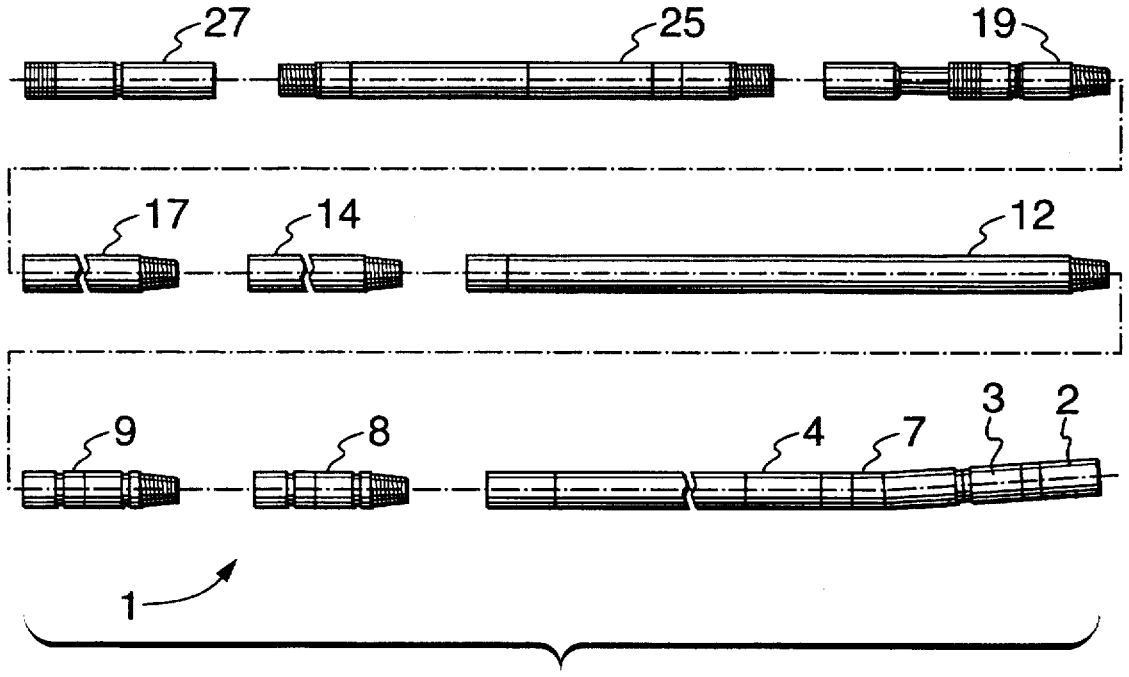
FIG. 1 is a diagrammatic view of a bottom hole assembly including an orienting tool as will be described herein.
Figure 2:
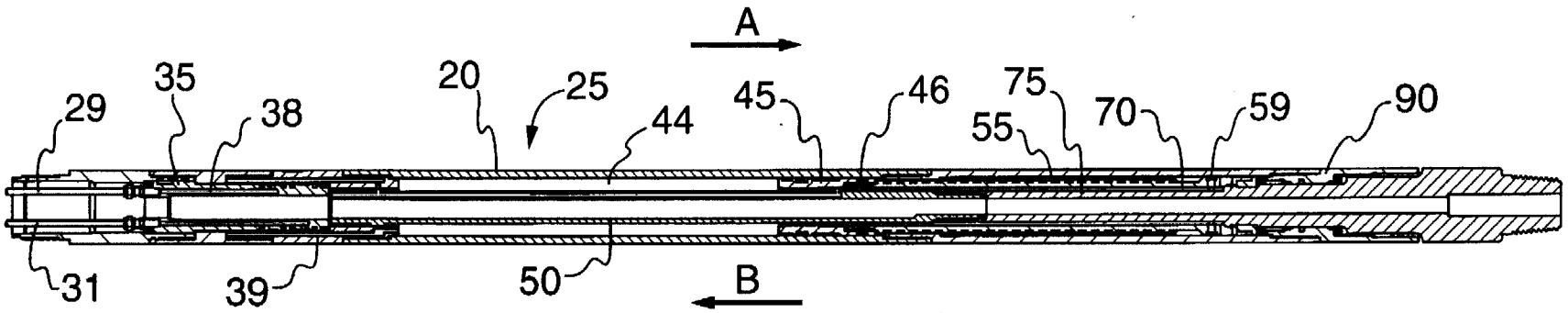
FIG. 2 is a cross-sectional view of the present orienting tool.

With reference to FIG. 1, there is shown diagrammatically a typical bottom hole assembly (BHA) 1 of tools suspended from the terminal end of the coiled tubing (not shown) for directional drilling of oil and gas wells. The BHA comprises a bit 2, a bearing assembly 3, a positive displacement motor (PDM) 4 with a bent housing (aka bent sub) 7, non-magnetic float subs 8 and 9, non-magnetic collar 12 including a mule shoe (not shown) for MWD sensors (also not shown), downhole pressure sub 14, a non-magnetic collar 17 for non-magnetic spacing, a coiled tubing quick disconnect 19 for release of the BHA should it become stuck in the hole, orienting tool 25 and a coiled tubing connector 27 for connecting the BHA to the coil tubing terminus.

Starting with a general overview, orienting tool 25 is actuated from the surface. Extending from the surface through the drill string are two hydraulic lines 29 and 31 which transfer hydraulic fluid from the surface to the tool with the lines alternating in function as either supply, relief or return lines. Preferably, these capillaries are made of stainless steel.

The hydraulic fluid is delivered to a flow diverter 35 at the top of the tool. The fluid is diverted from this point through flow paths 38 and 39 to the upper and lower portions 44 and 46, respectively, of a piston chamber for back-and-forth movement of piston 45 in the direction of arrows A and B along an inner piston mandrel 50. A piston spline 55 connected to the piston is slidably but non-rotatably supported within the tool housing and therefore follows the piston. The piston spline supports one or more guide pins 59 arranged to track along helically wound grooves 70 in an orienting mandrel 75. This causes the mandrel to rotate as the non-rotatable piston and piston spline move back and forth in the longitudinal direction of the tool. Mandrel 75 extends from the lower end of the tool through a bearing housing 90 and is adapted for connection to the remaining downhole portion of the BHA. Azimuthal control of the BHA is regulated by causing the mandrel to rotate in accordance with the direction of flow of hydraulic fluid in paths 38 and 39 to obtain the required orientation measured magnetically using known MWD instruments and techniques.

Figure 3:
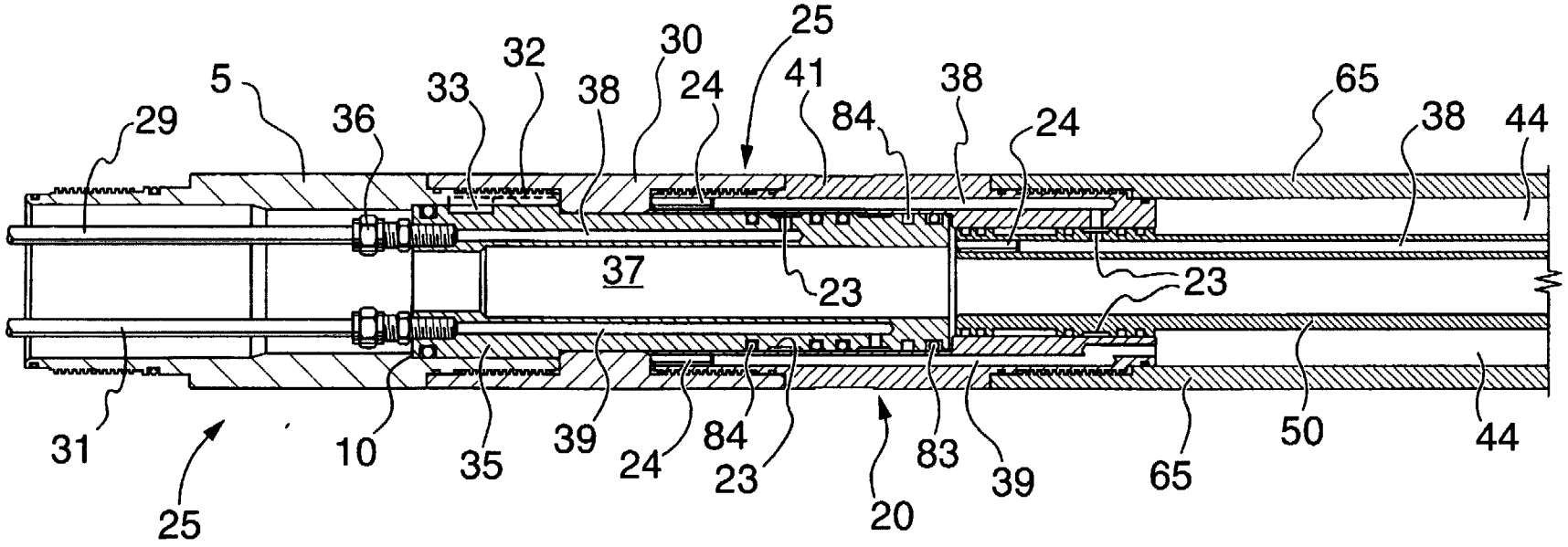
FIG. 3 is an enlarged cross-sectional view of an upper portion of the orienting tool of FIG. 2.

The entire tool is enclosed within a tubular housing 20 sub-divided into a number of threaded together segments with each segment enclosing and providing containment for a portion of the tool as will be described in some detail below. The orienting tool will now be described in greater detail starting at its upper end as seen most clearly in FIG. 3.

The upper portion of the tool comprises three tubular segments, namely a top sub 5, a flow diverter housing 30 and a piston end housing 41.

Top sub 5 is threaded at its upper end for connection to coiled tubing connector 27. The hydraulic capillaries 29 and 31 pass through the top sub for connection to flow diverter 35 such as by means of ¼ inch tube fittings 36.

The top sub's inner surface includes a circumferentially extending shoulder 10 that locates the flow diverter when fixed in place by connection of diverter housing 30. Top sub 5 additionally includes a slotted keyway 32 to slidably receive a key 33 on the flow diverter. This prevents relative rotation between the flow diverter and the surrounding housing so that the capillaries are not twisted in the coiled tubing.

The flow diverter is itself tubular in shape with a bore 37 extending its length for wire lines and the like and the flow of drilling fluid. Flow paths 38 and 39 extend longitudinally through the diverter and emerge as shown through the diverter's outer wall for fluid communication with the continuation of the flow paths through piston end housing 41.

Flow path 38 emerges through the inner wall of housing 41 for fluid communication with the continuation of the flow path through inner piston mandrel 50. The flow path eventually ends at port 42 (FIG. 4) in the piston mandrel's outer surface to provide fluid communication below piston 45 in lower piston chamber 46.

Flow path 39 emerges from the lower end of piston housing 41 for fluid communication above piston 45 in upper piston chamber 44. The piston chamber is defined by the annulus between piston mandrel 50 and tubular piston housing 65 being the next housing segment downhole of piston end housing 41. With fluid supply through path 39 and return through path 38, piston 45 will move downwardly in the direction of arrow A. The piston will move upwardly in the direction of arrow B with the reversal of flow and the piston can be held stationary if the pressure across both flow paths is equalized.

Circumferential grooves 23 in the outer surfaces of diverter 35 and piston mandrel 50 ensure continuous fluid communication with the remaining downhole portions of the flow paths whatever the relative angular orientation of the diverter and end housing 41 on the one hand, and the end housing and the upper end of piston mandrel 50 on the other. Brazed plugs 24 are used to seal the non-communicating ends of the flow paths in the end housing and piston mandrel.

Figure 4:
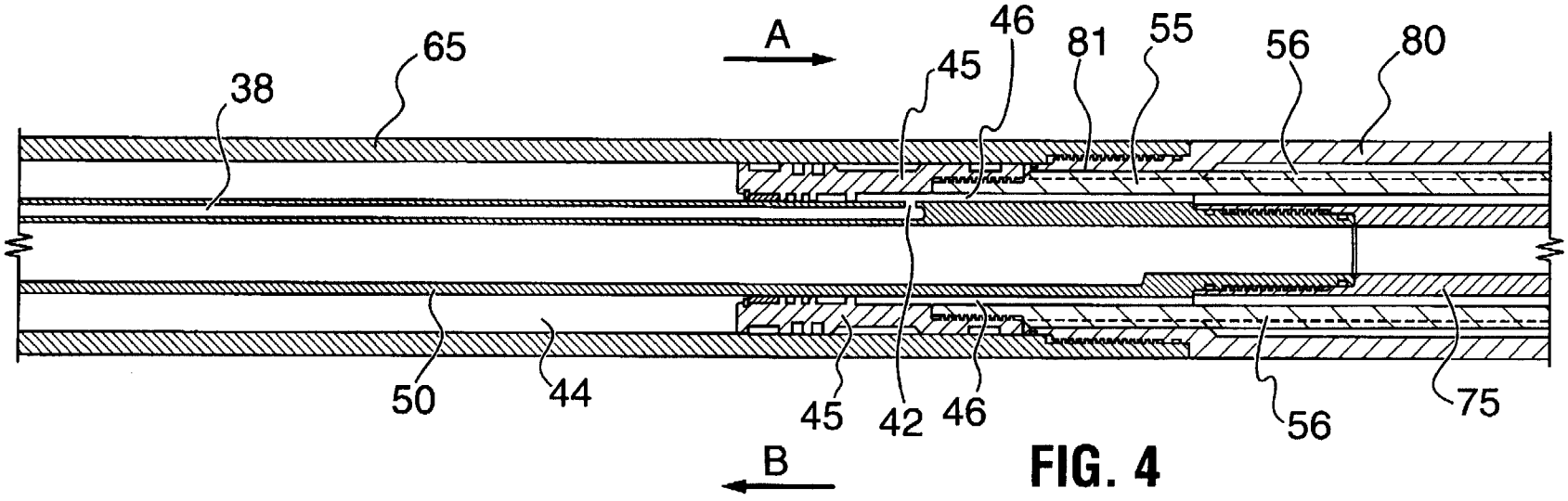
FIG. 4 is an enlarged cross-sectional view of a middle portion of the orienting tool of FIG. 2.
Figure 6:
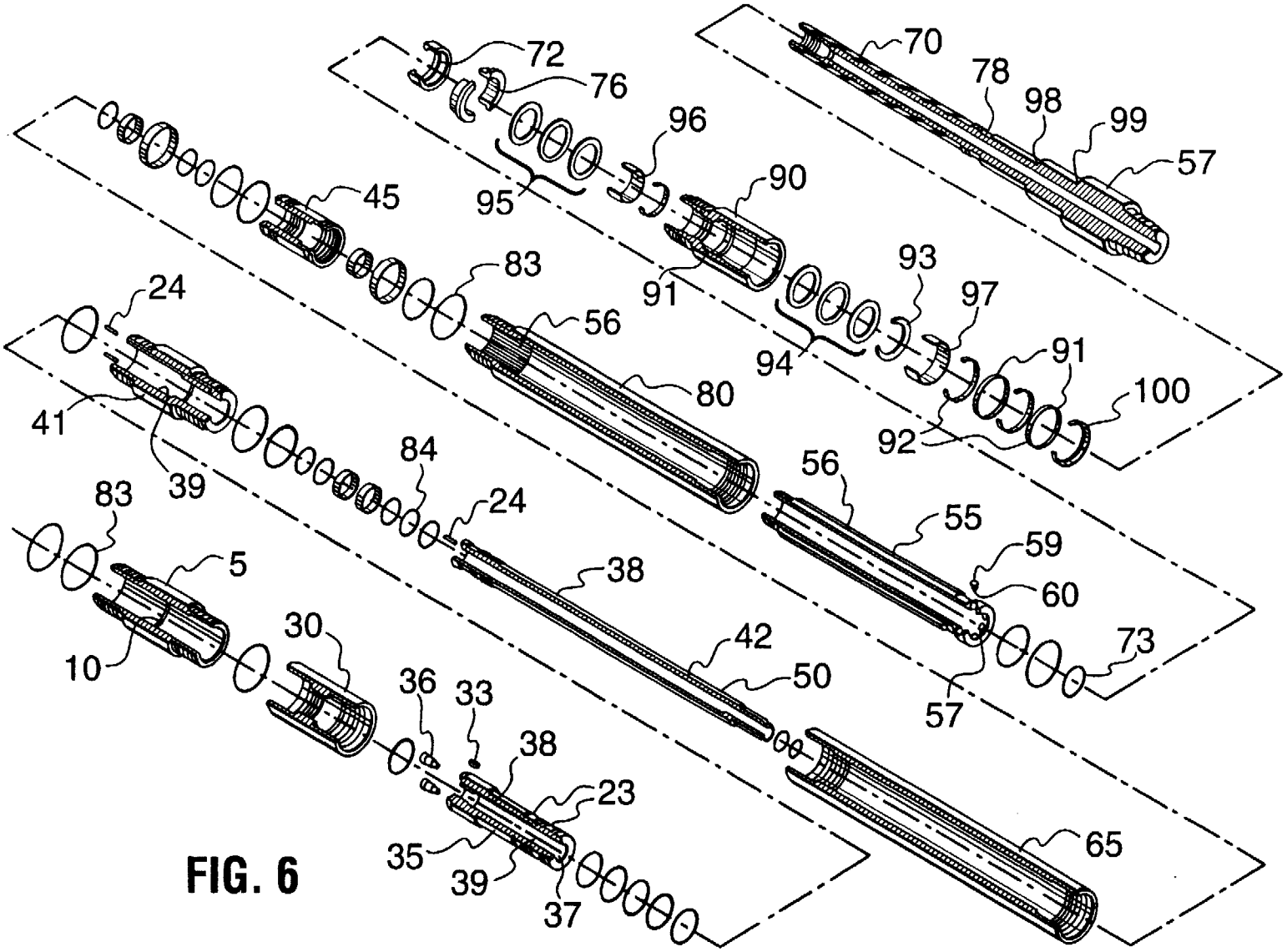
FIG. 6 is an exploded isometric view of the orienting tool of FIG. 2.
Figure 8:
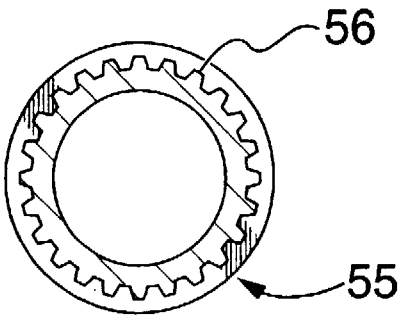
FIG. 8 is an end elevational view of the piston spline of FIG. 7.
Figure 10:
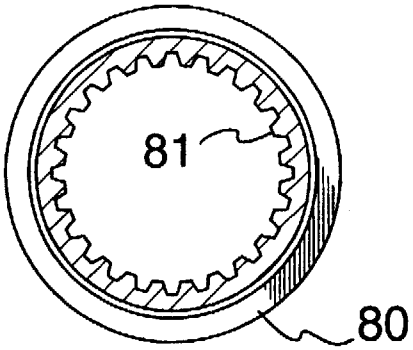
FIG. 10 is an end elevational view of the spline housing of FIG. 9.
Figure 7:
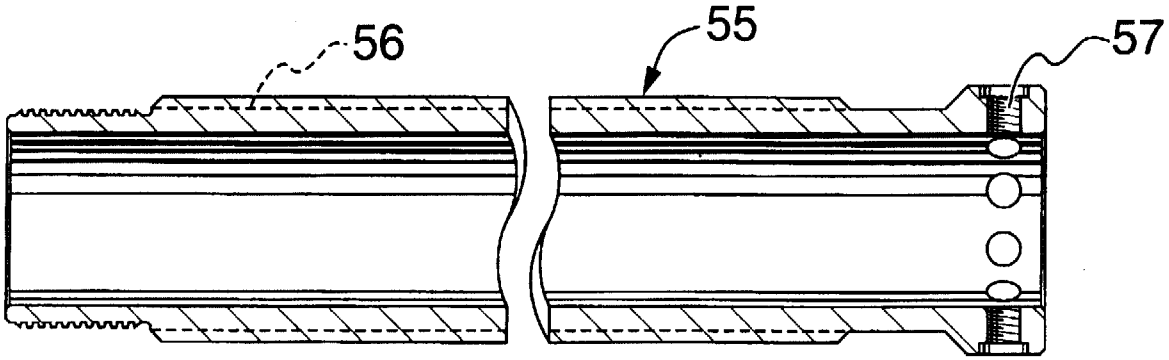
FIG. 7 is a side elevational cross-sectional view of a piston spline forming part of the present tool.
Figure 9:
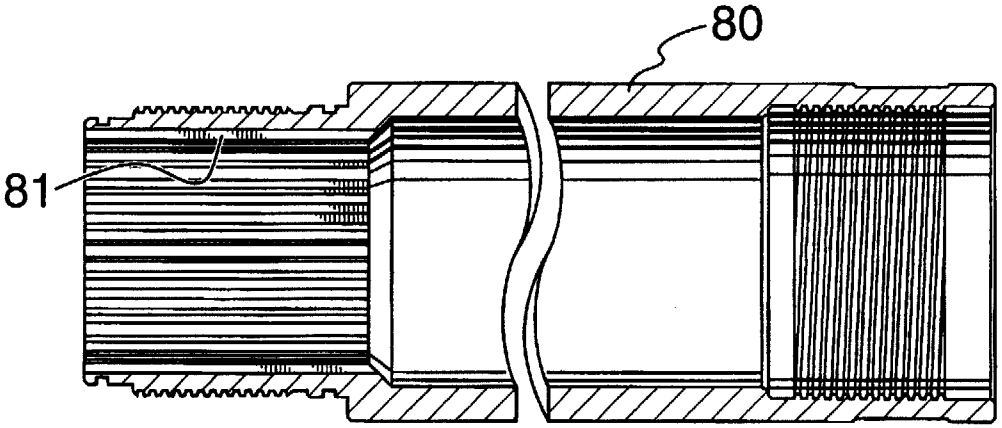
FIG. 9 is a side elevational cross-sectional view of a spline housing forming part of the present tool.

With reference to FIGS. 1, 4 and 6, the middle portion of the present tool is enclosed within piston housing 65 and piston spline housing 80 threadedly connected together as shown. Piston 45 moves as aforesaid back and forth along the polished outer surface of the piston mandrel 50 in response to the flow of hydraulic fluid through channels 38 and 39. The lower end of the piston is threaded to a piston spline 55 which follows the piston to also move back and forth in the direction of arrows A and B. The piston spline, shown separately in FIGS. 7 and 8, includes on its outer surface a plurality of spaced apart longitudinally extending splines 56 that mate with opposed splines 81 formed on the inner surface of spline housing 80 shown separately and most clearly in FIGS. 9 and 10. The meshing of the splines prevents rotation of the piston spline and attached piston 45 relative to the tool's outer housing.

With reference once again to FIGS. 5 and 7, the downhole end of piston spline 55 is formed with one or more threaded apertures 57 for a matching number of correspondingly threaded guide pins 59, each pin having a tip 60 extending radially inwardly to engage a respective helical groove 70 formed in the opposed outer surface of orienting mandrel 75. These left-hand grooves spiral around the outer surface of the mandrel preferably to provide 540° and up to perhaps 750° of mandrel rotation. The grooves run the length of the mandrel to its threaded connection to piston mandrel 50 which is slightly smaller in diameter than mandrel 75. The uphole end of the piston mandrel is enlarged somewhat in diameter (see FIG. 3) so that the opposed inner surface of piston end housing 41 acts as a bearing surface for the inner mandrel's rotation.

The pitch of helical groove 70 is advantageously chosen to provide an acceptable balance between rotational torque on the one hand and total mandrel rotation on the other for a predetermined mandrel length. In a preferred embodiment constructed by the applicant, ten guide pins track in a corresponding number of left-hand helical grooves 70 formed at a 30° pitch over the 18 inch length of the mandrel to yield 540° (1½ complete turns) of rotation for one complete throw of piston 45. Increasing the length of the mandrel or increasing the pitch of the grooves will increase total rotation at the price however of increased tool size or reduced torque, respectively.

As will be apparent, as the guide pins are moved back and forth in the direction of arrows A and B in concert with the back-and-forth movements of piston spline 55 and piston 45, the pins slide in grooves 70 forcing mandrel 75 to rotate.

With left-hand grooves, a downward stroke of piston 45 will impart a clockwise rotation to the orienting mandrel when viewed from the top of the tool and of course an upward stroke will cause a counterclockwise rotation when viewed from the same vantage point.

In an alternative embodiment, pins 59 can be replaced with involuted gear teeth formed on the inside of the piston spline adapted to track within involuted splines formed on the opposed outer surface of the orienting mandrel in place of helical grooves. Other arrangements are possible as well.

Figure 5:
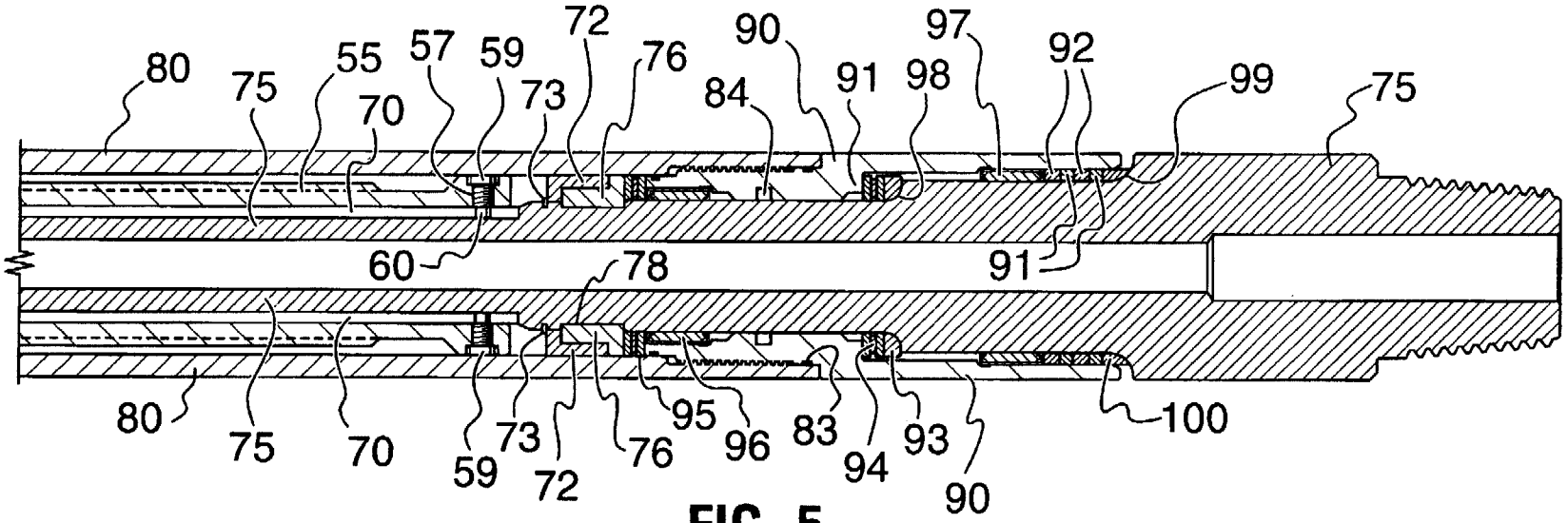
FIG. 5 is an enlarged cross-sectional view of a lower portion of the orienting tool of FIG. 2.

Mandrel 75 and piston mandrel 50 are located relative to spline housing 80 by means of a split ring arrangement that will now be described with reference to FIGS. 5 and 6. Prior to makeup of the mandrel and inner mandrel and their insertion into spline housing 80, a generally cup-shaped retaining ring 72 is fitted onto the mandrel from its uphole end until its engages and partially encloses a two (or more) part split ring 76 closely seated in a groove 78 extending about the mandrel's circumference. A snap ring 73 is used to locate the retaining ring in contact with the split ring. The mandrel is then inserted into the spline housing and a bearing housing 90 also previously installed over the mandrel is threaded to the spline housing 80 to complete the assembly.

To facilitate rotation of the mandrel relative to split ring 76 and bearing housing 90 while at the same time accommodating the substantial axial loads imposed in the uphole direction from the weight-on-bit applied while drilling and in the downhole direction from the considerable weight of the BHA, the present tool incorporates a number of adaptations. These include a thrust bearing/washer combination 95 between the upper end of the bearing housing 90 and split ring 76, a needle bearing 96 located just downstream of the thrust bearing between the mandrel's outer surface and the opposed inner surface of the bearing housing and a smooth, stress reducing concavely rounded shoulder 98 on the mandrel separated from an opposed shoulder 91 on bearing housing 90 by a thrust ring 93 and a thrust bearing/washer combination 94. A second concavely rounded shoulder 99 is formed on the mandrel where it emerges from the bearing housing and is spaced therefrom by another needle bearing 97, a pair of spacer rings 92 separated by NITROXILE[1] polypak seals 91 and a second spacer ring 100 that abuts against shoulder 99.

[1] Trade-mark

Sealing of the tool against ingress of drilling fluid and egress of hydraulic fluid is provided where required by a number of o-rings 83 and polypak seals 84, the use and placement of which are apparent from the drawings and will in any event be well within the knowledge of those skilled in this art.

For proper circulation of drilling fluid and the passage of wire lines, it will be seen particularly from FIG. 1 that bore 37 formed longitudinally through the flow diverter is continued through the piston mandrel and mandrel 75.

To assemble the tool, capillaries 29 and 31 are threaded through top sub 5 and connected to flow diverter 35 using tube fittings 36. Key 33 is aligned with keyway 32 so that the top sub can be pushed onto the flow diverter with the flow diverter then being locked into place by attachment of housing 30. Capillaries 29 and 31 are now anchored to the tool to prevent twisting. The remaining components are assembled together proceeding in the downhole direction of the tool with the various spacers, bearings and rings being preassembled onto the mandrel prior to its makeup with the piston mandrel and the outer housing. Obviously as well piston spline 55 must be inserted over the mandrel so that pins 59 can be installed to engage helical grooves 70 in the mandrel prior to insertion of the piston spline into spline housing 80.

In operation, hydraulic fluid is pumped under pressure from the surface through one of capillaries 29 and 31. The fluid will pass through the flow diverter into one or both of flow paths 38, 39 which direct the fluid through piston end housing 41. Fluid travelling through flow path 38 will be diverted through the inner piston mandrel to the lower piston chamber to force the piston up provided of course that flow path 39 is open on return. The upward movement of the piston translates into a counterclockwise rotation of the mandrel due to the left-hand rotation of helical grooves 70. Reversing the flow of hydraulic fluid through flow path 39 delivers the fluid to the upper piston chamber to force the piston down which translates into a clockwise rotation of the mandrel. To lock the tool at any given point in its rotation, the pressure across the two capillaries is simply equalized. Depending upon well depth, the hydrostatic head of the hydraulic fluid column in the capillaries can be sufficient in itself for this purpose. As will be appreciated, the present tool as described is operable independently of the well fluid rate, with or without weight-on-bit, it's infinitely adjustable in either rotational direction and it can be operated to change the wellbore's azimuth before, during or after drilling.

In view of the fact that the present tool already relies for its operation on hydraulic pressure supplied via capillaries 29 and 31, the tool can be advantageously modified to integrate its own hydraulic disconnect to operate on this same hydraulic pressure. The addition of an integral disconnect into the orienting tool means of course that the discreet disconnect 19 mentioned above can be eliminated from the tool string.

Figure 11:
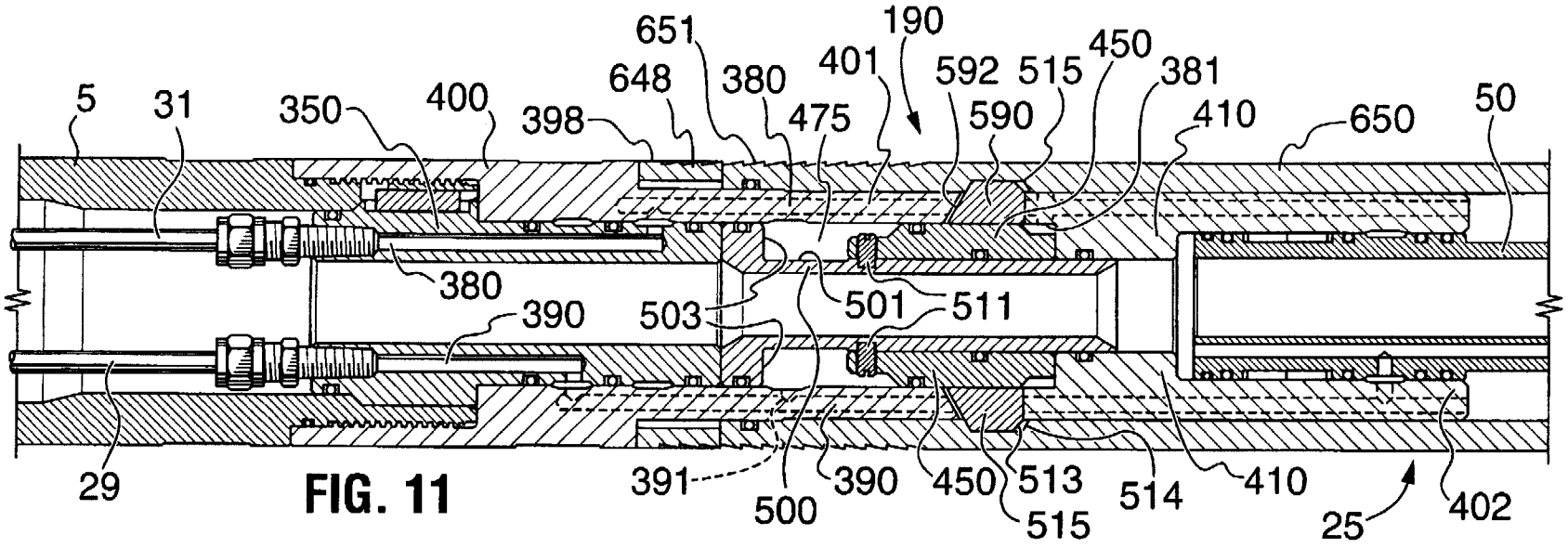
FIG. 11 is an enlarged cross-sectional view of an upper portion of the orienting tool modified to include a hydraulic disconnect.
Figure 12:
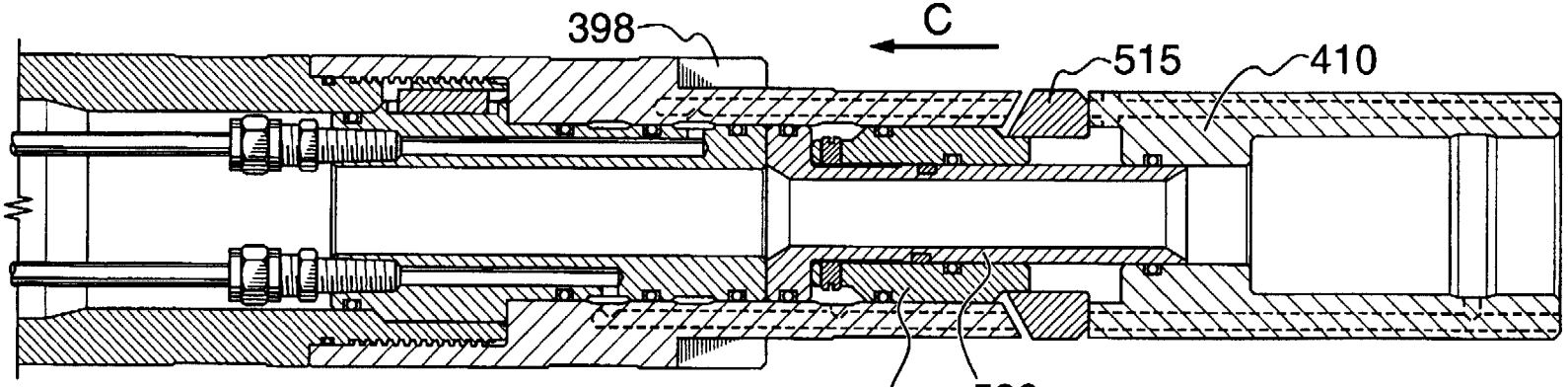
FIG. 12 is an enlarged cross-sectional view of the upper portion of the orienting tool shown in FIG. 11 with the disconnect in a released position.

Reference will now be made to FIGS. 11 and 12 illustrating an integral hydraulic disconnect incorporated into orienting tool 25. Like reference numerals have been used in FIGS. 11 and 12 to identify like elements appearing in the earlier Figures.

Reference is made initially to FIG. 11 showing the integral disconnect generally identified by numeral 190. The disconnect is shown prior to actuation.

As will be seen, hydraulic fluid is delivered to flow diverter 350 via capillaries 29 and 31. As previously described, the hydraulic fluid is diverted from this point through flow paths 380 and 390 to eventually reach opposite sides of piston 45. In this embodiment however, rather than paths 380 and 390 extending through piston end housing 41, they extend through a tubular disconnect housing 400 which replaces both end housing 41 and flow diverter housing 30 from the previously described embodiment.

At its uphole end, housing 400 is adapted for connection to flow diverter 350 and to top sub 5 in the same manner as described above with respect to flow diverter housing 30. The downhole portion 401 of housing 400 is reduced in diameter to fit concentrically and slidably into the uphole end of piston housing 650. The downhole end 402 of housing 400 is adapted to rotatably and slidably receive the upper end of piston mandrel 50 in the same manner as previously described with respect to piston end housing 41.

Housing 400 includes a radially inwardly directed annular shoulder 410 which defines the lower end of a piston chamber 475 formed in the annulus between the inner surface of housing 400 and the opposed outer surface 501 of a sleeve 500. Sleeve 500 extends from the lower end of flow diverter 350 to shoulder 410 as shown and includes an internal shoulder 503 that defines the upper end of chamber 475.

A disconnect piston 450 is slidably received into chamber 475 about sleeve 500 and is held in a fixed position as shown in FIG. 11 by means of a plurality (eg. 6) of shear screws 511 passing through the piston into sleeve 500. Moreover, the piston is also hydrostatically balanced by the hydrostatic pressure in flow paths 380 and 390 which communicate with respective opposite ends of the piston by means of ports 381 and 391 opening into chamber 475.

Piston 450 in the position shown in FIG. 11 supports a plurality (eg. 6) of keys 590 that protrude through correspondingly shaped apertures 592 in disconnect housing 400 and then into an opposed circumferential groove 515 formed into the inner wall of piston housing 650. These keys, when supported by the piston in the position shown in FIG. 11, prevent separation of disconnect housing 400 from piston housing 650.

If it becomes necessary to actuate the disconnect, the hydraulic pressure in flow path 380 is increased substantially above the hydrostatic pressure in flow path 390 to create a delta pressure of, for example, 7000 psi, acting across piston 450 sufficient to shear off shear screws 511. Piston 450 will then move in the direction of arrow C into the position shown in FIG. 12 which allows the keys to withdraw into the illustrated retracted position. Bevelling 513 and 514 on the keys and groove 515 respectively facilitate the collapse of the keys into their retracted position as the portion of the BHA uphole from housing 650 is withdrawn. Obviously, the keys retract sufficiently to completely disengage from groove 515 so that housing 400 can be slidably removed from housing 650 by normal withdrawal of the coiled tubing from the well. This leaves behind a buttress threaded fishing neck 651 on the exposed uphole end of housing 650 for retrieval of the stuck BHA using conventional recovery techniques.

Housing 400 includes a plurality of spaced apart longitudinally aligned lugs 398 that mesh with correspondingly spaced apart and aligned lugs 648 on housing 650 to prevent relative rotation between these two housings.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

We claim:

1. Apparatus for azimuthal orientation of a tool in a wellbore, said apparatus comprising:

a tubular housing;

mandrel means rotatably supported in said tubular housing and extending therefrom for connection to a tool for rotation thereof;

piston mandrel means axially aligned with and connected to said mandrel means for rotation therewith;

piston means longitudinally movable in an annulus between said piston mandrel means and said tubular housing and being non-rotatable relative to said tubular housing;

pin means longitudinally movable in concert with said piston means arranged to track in respective helical groove means in said mandrel means causing rotation of said mandrel means in response to longitudinal movement of said pin means; and flow path means for selective delivery of pressurized hydraulic fluid to either side of said piston means for rotating said mandrel means in either the clockwise or counterclockwise directions, or to both sides of said piston means equally to maintain said mandrel means in a fixed annular orientation.

2. The apparatus of claim 1 wherein said flow path means include a flow diverter disposed non-rotatably within said tubular housing for directing said pressurized hydraulic fluid to one or both sides of said piston means.

3. The apparatus of claim 2 wherein said flow diverter and said piston mandrel means include circumferential grooves adapted for continuous fluid communication along said flow path means regardless of the axial orientation of said piston mandrel means relative to said flow diverter following or during rotation of said piston mandrel means.

4. The apparatus of claim 1 further comprising piston follower means connecting said pin means to said piston means for longitudinal movement with said piston means.

5. The apparatus of claim 4 wherein said piston follower means include connecting means to slidably engage said tubular housing and prevent rotational movement of said piston follower means, said piston means and said pin means relative to said tubular housing.

6. The apparatus of claim 5 wherein said connecting means comprise a plurality of longitudinally extending splines for slidably mating with opposed splines on an inner surface of said tubular housing.

7. The apparatus of claim 6 wherein said piston follower means further include apertures therethrough for receiving respective ones of said pin means therein.

8. The apparatus of claim 7 wherein said pin means comprise a plurality of threaded guide pins having one end receivable into a respective one of said apertures in said piston follower means and the other end receivable into respective ones of said helical groove means in said mandrel means for slidable movement in said helical groove means.

9. The apparatus of claim 1 wherein said helical groove means on said mandrel means comprises involuted spline means and said pin means comprise involuted gear teeth movable longitudinally with said piston means for tracking within said involuted spline means on the opposed surface of said mandrel means to rotate said mandrel means.

10. The apparatus of claim 1 further comprising ring means concentrically disposed about said mandrel means interconnecting said mandrel means and said tubular housing to prevent the axial separation thereof.

11. The apparatus of claim 1 wherein said mandrel means and said piston mandrel means are threadedly connected together in fluid sealing relationship.

12. The apparatus of claim 1 wherein said helical groove means extend at least 360°.

13. The apparatus of claim 12 wherein the pitch of said helical groove means is substantially 30°.

14. The apparatus of claim 1 wherein said helical grooves extend at least 540°.

15. The apparatus of claim 14 wherein the pitch of said helical groove means is substantially 30°.

16. The apparatus of claim 1 wherein said helical groove means extend up to 750°.

17. The apparatus of claim 1 further including means allowing an uphole portion of said tubular housing to disconnect from a downhole portion of said tubular housing while said apparatus is in the wellbore, comprising:

means for interconnecting said uphole and downhole portions of said tubular housing to prevent the normal axial separation thereof;

a slidable member movable in said tubular housing between a first position in which said means for connecting continue to connect said uphole and downhole portions of said tubular housing and a second position wherein said means for connecting no longer connect said portions, allowing the axial separation thereof; and flow path means for delivery of pressurized fluid to said slidable member to cause movement thereof from said first to said second position when said uphole and downhole portions of said tubular housing are to be disconnected.

18. The apparatus of claim 17 wherein said uphole and downhole portions of said tubular housing are telescopically associated.

19. The apparatus of claim 18 wherein said means for interconnecting comprise key means extending between said uphole and downhole portions to interconnect the same.

20. The apparatus of claim 19 wherein said slidable member is an annular piston.

21. The apparatus of claim 20 wherein said annular piston, in said first position thereof, supports said key means between said uphole and downhole portions of said tubular housing.

22. The apparatus of claim 21 wherein said annular piston, in said second position thereof, permits said key means to move sufficiently to no longer interconnect said uphole and downhole portions.

23. The apparatus of claim 22 wherein said annular piston is maintained in said first position thereof by at least one shearable member.

24. The apparatus of claim 23 wherein said at least one shearable member is broken when the pressure of said pressurized fluid exceeds a predetermined pressure.

25. The apparatus of claim 23 wherein said at least one shearable member comprise shear pins interconnecting said annular piston and a cylindrical sleeve supporting said annular piston for longitudinal sliding movement thereof between said first and second positions.

26. Apparatus for azimuthal orientation of a tool in a wellbore, said apparatus comprising:

a tubular housing;

mandrel means rotatably supported in said tubular housing and extending therefrom for connection to a tool for rotation thereof;

piston mandrel means axially aligned with and connected to said mandrel means;

piston means longitudinally movable in an annulus between said piston mandrel means and said tubular housing and being non-rotatable relative to said tubular housing;

pin means longitudinally movable in concern with said piston means arranged to track in respective helical groove means in said mandrel means causing rotation of said mandrel means in response to longitudinal movement of said pin means; and flow path means for selective delivery of pressurized hydraulic fluid to either side of said piston means for rotating said mandrel means in either the clockwise or counterclockwise directions, or to both sides of said piston means equally to maintain said mandrel means in a fixed annular orientation, said flow path means including flow diverting means non-rotatably disposed in said tubular housing for connection at one end thereof to conduit means circulating said pressurized fluid to said apparatus from the surface.

27. The apparatus of claim 26 wherein said piston mandrel means are connected to said mandrel means for rotation therewith.

28. Apparatus for azimuthal orientation of a tool in a wellbore, said apparatus comprising:

a tubular housing;

mandrel means rotatably supported in said tubular housing and extending therefrom for connection to a tool for rotation thereof;

piston mandrel means axially aligned With and connected to said mandrel means;

piston means longitudinally movable in an annulus between said piston mandrel means and said tubular housing and being non-rotatable relative to said tubular housing;

piston follower means connected to said piston means to move longitudinally therewith in the annulus between said mandrel means and said piston mandrel means and said tubular housing, and having on an outer surface thereof means slidably but non-rotatably engaging an inner surface of said tubular housing to prevent rotation of said piston follower means and said piston means relative to said tubular housing;

pin means supported in said piston follower means and arranged to track in respective helical groove means in said mandrel means causing rotation of said mandrel means in response to longitudinal movement of said pin means; and flow path means for selective delivery of pressurized hydraulic fluid to either side of said piston means for rotating said mandrel means in either the clockwise or counterclockwise directions, or to both sides of said piston means equally to maintain said mandrel means in a fixed annular orientation.

29. The apparatus of claim 28 wherein said piston mandrel means are connected to said mandrel means for rotation therewith.

* * * * *

UNITED STATES PATENT AND TRADEMARK OFFICE

CERTIFICATE OF CORRECTION

PATENT NO. : 5,894,896

DATED : April 20, 1999

INVENTOR(S) : Smith, et. al.

It is certified that error appears in the above-identified patent and that said Letters Patent is hereby corrected as shown below:

Column 9, line 66, "grooves" should read --groove means--.

Column 11, line 21, "With" should read --with--.

Signed and Sealed this

Twenty-fourth Day of August, 1999

*Attest:*

Q. TODD DICKINSON

*Attesting Officer*

*Acting Commissioner of Patents and Trademarks*